US009919528B2

(12) United States Patent
Takabe et al.

(10) Patent No.: US 9,919,528 B2
(45) Date of Patent: Mar. 20, 2018

(54) LIQUID EJECTING HEAD, LIQUID EJECTING APPARATUS, AND LIQUID EJECTING HEAD MANUFACTURING METHOD

(71) Applicant: SEIKO EPSON CORPORATION, Tokyo (JP)

(72) Inventors: Motoki Takabe, Shiojiri (JP); Yasuyuki Matsumoto, Azumino (JP); Shunya Fukuda, Azumino (JP); Koji Asada, Azumino (JP); Daisuke Kobayashi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/279,269

(22) Filed: Sep. 28, 2016

(65) Prior Publication Data

US 2017/0087841 A1 Mar. 30, 2017

(30) Foreign Application Priority Data

Sep. 29, 2015 (JP) ..... 2015-190942

(51) Int. Cl.
*B41J 2/16* (2006.01)

(52) U.S. Cl.
CPC ..... *B41J 2/1629* (2013.01); *B41J 2/161* (2013.01); *B41J 2/162* (2013.01); *B41J 2/1628* (2013.01); *B41J 2/1631* (2013.01); *B41J 2/1634* (2013.01)

(58) Field of Classification Search
CPC ..... B41J 2/14; B41J 2/14016; B41J 2/1404; B41J 2/14201; B41J 2/14272; B41J 2/1433; B41J 2/16; B41J 2/1601; B41J 2/1607; B41J 2/1609; B41J 2/162
See application file for complete search history.

(56) References Cited

U.S. PATENT DOCUMENTS 8,226,210 B2 * 7/2012 Otokita ..... B41J 2/14314 216/27

FOREIGN PATENT DOCUMENTS

| | | | |
|---|---|---|---|
| JP | 2002-001953 | * | 1/2002 |
| JP | 2009-051153 | | 3/2009 |
| JP | 2014-148096 | | 8/2014 |

* cited by examiner

*Primary Examiner* — Juanita D Jackson
(74) *Attorney, Agent, or Firm* — Workman Nydegger

(57) ABSTRACT

A liquid ejecting head includes a pressure chamber formation substrate having a pressure chamber formed therein, a flow path formation substrate that is connected to the pressure chamber formation substrate, and that has a flow path in communication with the pressure chamber formed in a state penetrating through the flow path formation substrate in a thickness direction thereof, and a nozzle plate that is connected to the flow path formation substrate on an opposite side to the pressure chamber formation substrate, and that has a nozzle in communication with the flow path opened therein. The flow path formation substrate is configured from a single substrate, and an opening area on a pressure chamber side of the flow path is formed wider than an opening area on a nozzle side of the flow path.

11 Claims, 6 Drawing Sheets

LIQUID EJECTING HEAD, LIQUID EJECTING APPARATUS, AND LIQUID EJECTING HEAD MANUFACTURING METHOD

The entire disclosure of Japanese Patent Application No: 2015-190942, filed Sep. 29, 2015 is expressly incorporated by reference herein in its entirety.

BACKGROUND

1. Technical Field

The present invention relates to a liquid ejecting head provided with a flow path that places a pressure chamber and a nozzle in communication with each other, a liquid ejecting apparatus, and a liquid ejecting head manufacturing method.

2. Related Art

Liquid ejecting apparatuses are apparatuses that are provided with a liquid ejecting head to eject various liquids out from the head. Examples of such liquid ejecting apparatuses include image recording apparatuses such as ink jet printers or ink jet plotters, and recently application is also being made to various manufacturing apparatuses exploiting the ability to cause tiny amounts of liquid to land accurately at specific positions. For example, application is being made to display manufacturing apparatuses for manufacturing color filters for liquid crystal displays and the like, electrode forming apparatuses for forming electrodes for organic electro luminescence (EL) displays, face emission displays (FED), and the like, and chip manufacturing apparatuses for manufacturing biochips (biochemical devices). A recording head of an image recording apparatus ejects liquid ink, and a colorant ejection head of a display manufacturing apparatus ejects red (R), green (G), and blue (B) colorants. An electrode material ejection head of an electrode forming apparatus ejects liquid electrode material, and a bioorganic material ejection head of a chip manufacturing apparatus ejects a solution of bioorganic material.

Liquid ejecting heads include those liquid ejecting heads stacked with a nozzle plate in which nozzles are formed, a flow path formation substrate in which penetrating flow paths in communication with the nozzles are formed, and a pressure chamber formation substrate in which pressure chambers in communication with the penetrating flow paths are formed. Liquid in the pressure chambers is ejected from the nozzles through the penetrating flow path by driving piezoelectric elements (a type of actuator). In such configurations, penetrating flow paths connecting the nozzles and the pressure chambers together function as buffers, and so the cross-sectional area of the penetrating flow paths (flow path area) is formed larger than an opening diameter of the nozzles. Steps configured by a surface of the nozzle plate are thereby formed at boundaries between the penetrating flow paths and the nozzles (namely, at a boundary between the nozzle plate and the flow path formation substrate). There is a possibility of liquid ejection being undesirably affected if liquid or the like pools at this step. For example, an increase in viscosity of pooled liquid could alter the liquid ejection characteristics, or pooled air bubbles could alter the liquid ejection characteristics. Accordingly, technology has been described in which a cross-sectional area (flow path area) of a penetrating flow path (ejection flow path) connecting a pressure chamber and a nozzle together is configured so as to decrease on progression from the pressure chamber side toward the nozzle side, thereby reducing the size of the step formed at the boundary between the nozzle and the penetrating flow path (for example, JP-A-2002-1953).

There is recently demand to eject liquid in even smaller amounts, in order to record higher resolution images and the like. There is therefore a tendency toward smaller nozzle diameters. In the configuration of the ejection flow path described in JP-A-2002-1953, liquid, air bubbles, and the like could not be adequately suppressed from pooling if the nozzle diameter were to be reduced. Namely, the ejection flow path described in JP-A-2002-1953 is formed by stacking plural flow path formation plates, thereby forming very small steps at right angles at the boundaries between the respective flow path formation plates. Accordingly, tiny amounts of liquid, air bubbles, and the like could pool at these very small steps. Reducing the nozzle diameter also reduces the amount of liquid that is ejected, and so even tiny amounts of pooled liquid, air bubbles, and the like could affect liquid ejection. Moreover, the shape of the ejection flow paths and the size of the steps could change as a result of positional misalignment between the respective flow path formation plates, resulting in unstable liquid ejection characteristics.

SUMMARY

An advantage of some aspects of the invention is providing a liquid ejecting head, a liquid ejecting apparatus, and a liquid ejecting head manufacturing method capable of suppressing liquid or the like from pooling in a flow path that places a pressure chamber and a nozzle in communication with each other.

A liquid ejecting head of an aspect of the invention includes a pressure chamber formation substrate having a pressure chamber formed therein, a flow path formation substrate that is connected to the pressure chamber formation substrate, and that has a flow path in communication with the pressure chamber formed in a state penetrating through the flow path formation substrate in a thickness direction thereof, and a nozzle plate that is connected to the flow path formation substrate on an opposite side to the pressure chamber formation substrate, and that has a nozzle in communication with the flow path opened therein. The flow path formation substrate is configured from a single substrate, and an opening area on a pressure chamber side of the flow path is formed wider than an opening area on a nozzle side of the flow path.

According to this configuration, the opening area on the pressure chamber side of the flow path is formed wider than the opening area on the nozzle side of the flow path. Namely, the opening area on the nozzle side of the flow path is formed narrower than the opening area on the pressure chamber side of the flow path. Accordingly, a step inside the flow path at a boundary between the flow path formation substrate and the nozzle plate can be made smaller. This thereby enables liquid, air bubbles, and the like to be suppressed from pooling inside the flow path. Moreover, since the flow path is formed in the flow path formation substrate configured from a single substrate, the number of steps inside the flow path can be set as desired. Moreover, variation in the shape of the flow paths as a result of positional misalignment between substrates, as can occur when a flow path formation substrate is configured from plural substrates (namely, in cases in which flow paths are formed by stacking plural substrates) does not occur, enabling variation in liquid ejection characteristics to be suppressed. This thereby enables more stable liquid ejection than in cases in which the flow path formation substrate is configured from plural substrates.

In the above configuration, preferably a cross-sectional area of the flow path in a plane orthogonal to the thickness direction widens in steps on progression toward the pressure chamber side.

According to this configuration, the cross-sectional area of the flow path widens in steps on progression toward the pressure chamber side. This thereby enables the step inside the flow path at the boundary between the flow path formation substrate and the nozzle plate to be made smaller, while suppressing an increase in resistance to the liquid inside the flow path.

In any of the configurations described above, the flow path preferably includes at least a first flow path portion having a first area as a cross-sectional area in a plane orthogonal to the thickness direction, and a second flow path portion having a second area wider than the first area as a cross-sectional area in a plane orthogonal to the thickness direction. Moreover, an inner face of a flow path connecting the first flow path portion and the second flow path portion together is preferably inclined with respect to a plane orthogonal to the thickness direction.

According to this configuration, the inner face of the flow path connecting the first flow path portion and the second flow path portion (a step between the first flow path portion and the second flow path portion) is inclined with respect to the flow path formation substrate, thereby enabling liquid, air bubbles, and the like to be further suppressed from pooling inside the flow path.

In the above configuration, the inclined face is preferably inclined at an angle of no less than 40° and no greater than 60° with respect to the plane orthogonal to the thickness direction.

According to this configuration, the inclined inner face of the flow path is inclined at an angle of no less than 40° and no greater than 60° with respect to the plane orthogonal to the thickness direction. This thereby enables the flow of liquid inside the flow path to be made even smoother.

In any of the configurations described above, the flow path formation substrate is preferably a silicon single crystal substrate. Moreover, a plane orientation of a face of the flow path formation substrate on the opposite side to the face connected to the nozzle plate is preferably that of a (110) plane.

According to this configuration, the flow path formation substrate is a silicon single crystal substrate with a surface in a (110) plane, thereby enabling the flow path to be formed easily and with high precision by forming the flow path using wet etching. Manufacture of the flow path formation substrate is accordingly facilitated as a result.

A liquid ejecting apparatus of an aspect of the invention includes the liquid ejecting head of any of the configurations described above.

A liquid ejecting head manufacturing method of an aspect of the invention is a manufacturing method for a liquid ejecting head including a pressure chamber formation substrate having a pressure chamber formed therein, a flow path formation substrate that is connected to the pressure chamber formation substrate and that has a flow path in communication with the pressure chamber formed in a state penetrating through the flow path formation substrate in a thickness direction thereof, and a nozzle plate that is connected to the flow path formation substrate on an opposite side to the pressure chamber formation substrate, and that has a nozzle in communication with the flow path opened therein. The manufacturing method includes forming a first mask layer on a face of the flow path formation substrate on the side for connection to the nozzle plate to mask against an etching liquid that etches the flow path formation substrate, and removing the first mask layer at a position for forming the flow path so as to form a first opening, forming a second mask layer on a face of the flow path formation substrate on the side for connection to the pressure chamber formation substrate to mask against an etching liquid, and removing the second mask layer at a position for forming the flow path so as to form a second opening with a wider opening area than the first opening, forming a through hole that places the first opening and the second opening in communication through the flow path formation substrate, forming the flow path by exposing the first opening, the second opening, and the through hole to an etching liquid, enlarging the mask openings by widening the opening areas of the first opening and the second opening, and enlarging the flow path so as to enlarge a cross-sectional area of at least a portion of the flow path by exposing the first opening and the second opening having enlarged opening areas, and exposing the through hole, to etching liquid. The mask opening enlarging and the flow path enlarging are each performed at least once.

According to this method, the flow path can easily be formed with its cross-sectional area widening in steps on progression toward the pressure chamber side. Namely, manufacture of the flow path formation substrate is facilitated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Explanation follows regarding an embodiment of the invention, with reference to the attached drawings. The embodiment described below includes various limitations as preferable specific examples of the invention. However, the scope of the invention is not limited thereby unless specifically indicated to be so in the following explanation. Moreover, in the following explanation, explanation is given using the examples of an ink jet recording head (referred to below as a recording head), this being a type of liquid ejecting head according to the invention, and an ink jet printer (referred to below as a printer), this being a type of liquid ejecting apparatus installed therewith.

Figure 1:
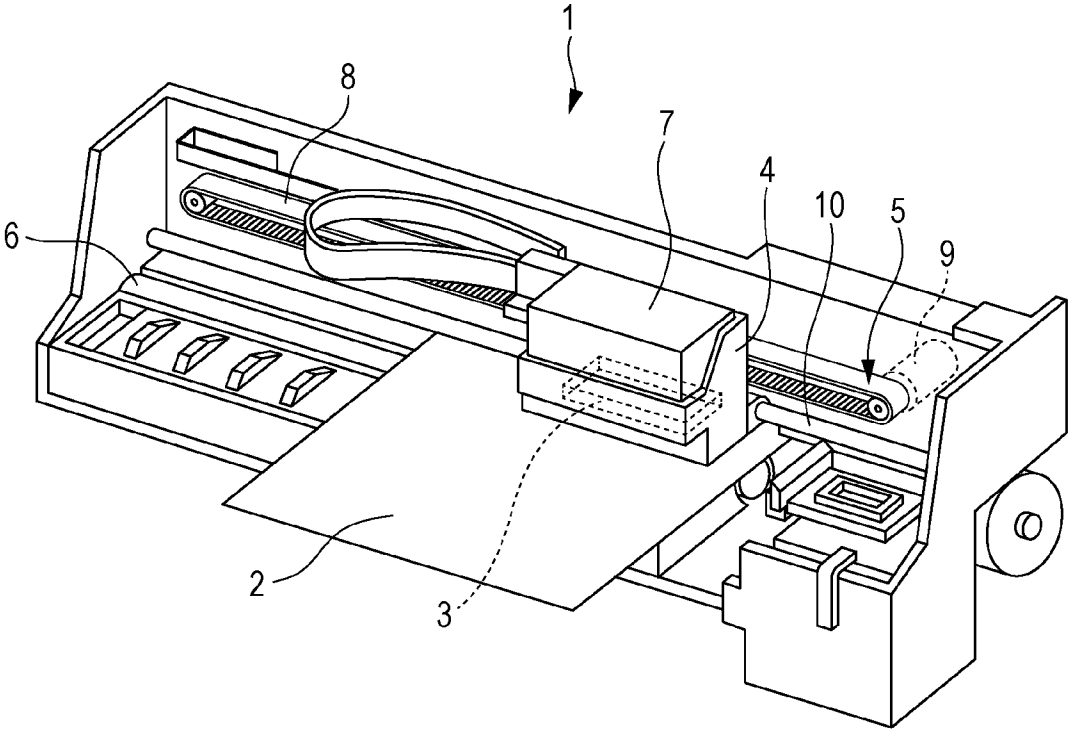
FIG. 1 is a perspective view to explain configuration of a printer.

Explanation follows regarding configuration of a printer 1, with reference to FIG. 1. The printer 1 is a device that ejects ink (a type of liquid) onto the surface of a recording medium 2 such as recording paper (a type of landing target) to record images or the like. The printer 1 includes a recording head 3, a carriage 4 to which the recording head 3 is attached, a carriage moving mechanism 5 that moves the carriage 4 in a main scanning direction, a transport mechanism 6 that transports the recording medium 2 in a sub-scanning direction, and the like. The ink is stored in an ink cartridge 7 serving as a liquid supply source. The ink cartridge 7 is detachably mounted to the recording head 3. Note that configuration may be made in which an ink cartridge is disposed on a main body side of the printer, and ink from the ink cartridge is supplied to the recording head through ink supply tubes.

The carriage moving mechanism 5 includes a timing belt 8. The timing belt 8 is driven by a pulse motor 9 such as a DC motor. Accordingly, when the pulse motor 9 is actuated, the carriage 4 is guided along a guide rod 10 spanning across the printer 1, and moves reciprocally in the main scanning direction (a width direction of the recording medium 2). The position of the carriage 4 in the main scanning direction is detected by a linear encoder (not illustrated in the drawings), this being a type of position information detection unit. The linear encoder sends detection signals, namely, encoder pulses (a type of position information) to a controller of the printer 1.

Figure 2:
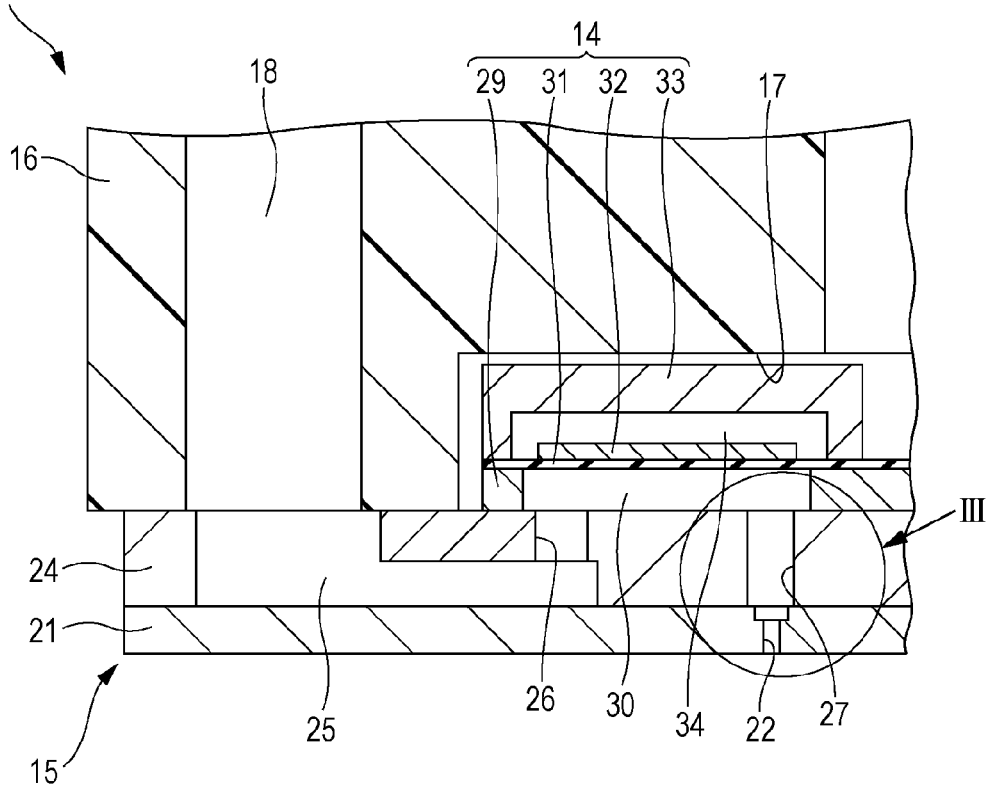
FIG. 2 is an enlarged cross-section of relevant portions of a recording head.
Figure 3:
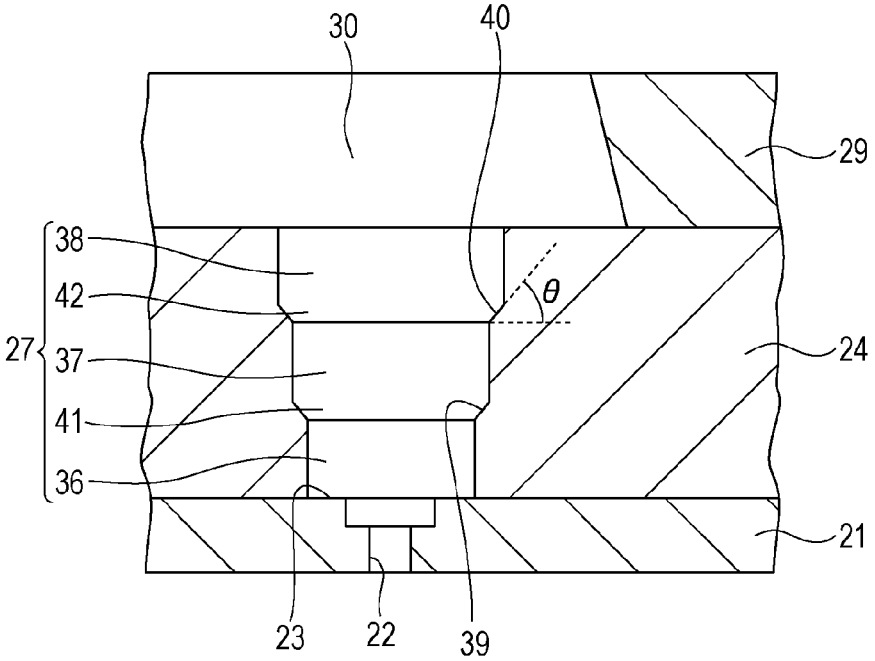
FIG. 3 is an enlargement of the region III in FIG. 2.

Next, explanation follows regarding the recording head 3. FIG. 2 is a cross-section of the recording head 3, sectioned along a direction orthogonal to a nozzle array direction. FIG. 3 is an enlargement of the region III in FIG. 2, and is a cross-section to explain configuration of a penetrating flow path 27. As illustrated in FIG. 2, the recording head 3 of the present embodiment is attached to a head case 16 in a state in which piezoelectric devices 14 and a flow path unit 15 are stacked. Note that the stacking direction of the various members is described as the up-down direction for convenience.

The head case 16 is a box shaped member made from a synthetic resin. A liquid entry path 18 is formed inside the head case 16. The liquid entry path 18, together with a common liquid chamber 25, described later, configures a space that stores ink common to plural pressure chambers 30 provided in a row. Note that an upper end portion of the liquid entry path 18 is in communication with the ink cartridge 7 through a liquid flow path, not illustrated in the drawings. A housing space 17, in which the piezoelectric devices 14 are housed, is formed in a lower portion of the head case 16. Configuration is made such that the piezoelectric devices 14 stacked on the flow path unit 15 (flow path formation substrate 24) are housed inside the housing space 17 in a state in which the flow path unit 15 is positioned and joined with respect to a lower face of the head case 16.

The flow path unit 15 includes a nozzle plate 21 penetrated by ink ejecting nozzles 22, and the flow path formation substrate 24 provided with the common liquid chamber 25 and the like. The nozzle plate 21 is a hard plate member made from silicon, and is connected to a lower face of the flow path formation substrate 24 (a face on the opposite side to a face to which the piezoelectric device 14 (pressure chamber formation substrate 29) is connected). For example, the nozzle plate 21 is manufactured from a silicon single crystal substrate with surfaces (an upper face and a lower face) having a crystal plane orientation of that of a (110) plane. The nozzle plate 21 is formed with plural of the nozzles 22 in a row. The plural nozzles 22 formed in a row (nozzle row) are provided at uniform intervals between a nozzle 22 at one end side and a nozzle 22 at another end side, at a pitch corresponding to a dot formation density. As illustrated in FIG. 2 and FIG. 3, each of the nozzles 22 is formed with a wider (larger) opening area at an upper face side (flow path formation substrate 24 side) than the opening area at a lower face side (opposite side to the flow path formation substrate 24). The opening area at the upper face side of each nozzle 22 is formed narrower (smaller) than the opening area of a lower face side of the penetrating flow path 27, described later. Accordingly, as illustrated in FIG. 3, a step 23 configured by the upper face of the nozzle plate 21 is formed at an edge of an opening of the nozzle 22 into the penetrating flow path 27 at a boundary between the penetrating flow path 27 and the nozzle 22.

The flow path formation substrate 24 is a hard plate member made of silicon, and is connected to a lower face of the piezoelectric devices 14 (pressure chamber formation substrate 29). The flow path formation substrate 24 of the present embodiment is manufactured from a single silicon single crystal substrate with surfaces (an upper face and a lower face) having a crystal plane orientation of that of a (110) plane. The flow path formation substrate 24 is formed with the common liquid chamber 25, individual communication paths 26, and the penetrating flow paths 27. The common liquid chamber 25 is formed as a common flow path to the plural pressure chambers 30, and is elongated along the row direction of the pressure chambers 30 (the nozzle array direction). The respective pressure chambers 30 are in communication with the common liquid chamber 25 through the individual communication paths 26 formed in the flow path formation substrate 24. Namely, ink inside the common liquid chamber 25 is distributed to the respective pressure chambers 30 through the individual communication paths 26. The penetrating flow paths 27 (corresponding to a flow path of the invention) are formed in a state penetrating through the flow path formation substrate 24 in the thickness direction, and are flow paths respectively connecting the nozzles 22 to the corresponding pressure chambers 30. Namely, an upper end of each penetrating flow path 27 is in communication with a pressure chamber 30, and a lower end of the penetrating flow path 27 is in communication with a nozzle 22. Note that the configuration of the penetrating flow path will be described in detail later.

The common liquid chamber 25, the individual communication paths 26, and the penetrating flow paths 27 of the present embodiment are formed by using anisotropic etching (wet etching) to remove a portion of the flow path formation substrate 24. Accordingly, the common liquid chamber 25, the individual communication paths 26, and the penetrating flow paths 27 are primarily bounded by planes (for example the (111) plane) arising from the crystal properties of silicon. Namely, the common liquid chamber 25, the individual communication paths 26, and the penetrating flow paths 27 of the present embodiment are formed in parallelogram shapes or the like in plan view.

As illustrated in FIG. 2, the piezoelectric devices 14 of the present embodiment are units configured by stacking the pressure chamber formation substrate 29, a diaphragm 31, a piezoelectric element 32, and a sealing plate 33. The piezoelectric devices 14 are formed with a size that can be housed inside the housing space 17, and the piezoelectric device 14 are housed inside the housing space 17.

The pressure chamber formation substrate 29 is a hard plate member made from silicon, and, for example, is manufactured from a silicon single crystal substrate with surfaces (an upper face and a lower face) having a crystal plane orientation of that of a (110) plane. The pressure chamber formation substrate 29 is provided with plural spaces for forming the pressure chambers 30 in a row along the nozzle array direction by etching so as to completely remove portions of the pressure chamber formation substrate 29 in the thickness direction. These spaces are bounded from below by the flow path formation substrate 24, and bounded from above by the diaphragm 31, thereby configuring the pressure chambers 30. The spaces, namely, the pressure chambers 30, are formed elongated in a direction orthogonal to the nozzle array direction. One length direction side end portions of the respective pressure chambers 30 are in communication with the individual communication paths 26, and other length direction side end portions of the respective pressure chambers 30 are in communication with the penetrating flow paths 27.

The diaphragm 31 is a thin film member with elastic properties, and is stacked on an upper face (a face on the opposite side to the flow path formation substrate 24 side) of the pressure chamber formation substrate 29. The diaphragm 31 seals off upper openings of the spaces forming the pressure chambers 30. In other words, the diaphragm 31 bounds upper faces of the pressure chambers 30. Portions of the diaphragm 31 corresponding to the pressure chambers 30 (more specifically, the upper openings of the pressure chambers 30) function as displacement portions that are displaced in a direction away from the nozzles 22 or in a direction approaching the nozzles 22 accompanying flexural deformation of the piezoelectric elements 32. Namely, regions of the diaphragm 31 corresponding to the upper openings of the pressure chambers 30 configure drive regions where flexural deformation is permitted. The deformation (displacement) of the drive regions (displacement portions) changes the volume of the pressure chambers 30. Regions of the diaphragm 31 away from the upper openings of the pressure chambers 30 configure non-drive regions where flexural deformation is prevented.

The piezoelectric elements 32 are stacked on the diaphragm 31 at the regions corresponding to the respective pressure chambers 30. The piezoelectric elements 32 of the present embodiment are what are referred to as flexural mode piezoelectric elements. Plural of the piezoelectric elements 32 are provided in a row along the nozzle array direction, corresponding to the respective nozzles 22. The respective piezoelectric elements 32 are, for example, configured by stacking a lower electrode layer, a piezoelectric body layer, and an upper electrode layer, in that sequence. In the piezoelectric elements 32 configured in this manner, when an electric field is applied between the upper electrode layer and the lower electrode layer according to a potential difference between the two electrodes, flexural deformation occurs in the direction away from the nozzles 22 or in the direction approaching the nozzles 22. Note that a lead electrode, not illustrated in the drawings, is provided extending from each of the piezoelectric elements 32 to the outside of a piezoelectric element housing space 34, described later, and is connected to a wiring member such as a flexible cable, not illustrated in the drawings.

As illustrated in FIG. 2, the sealing plate 33 is a substrate formed with the piezoelectric element housing space 34 that is capable of housing the piezoelectric elements 32. The sealing plate 33 is joined above the diaphragm 31 in a state in which the piezoelectric elements 32 are housed inside the piezoelectric element housing space 34. Note that a flat plate shaped sealing plate that is not formed with the piezoelectric element housing space may also be employed. In such cases, the thickness of an adhesive joining the diaphragm and the sealing plate together is made thicker, and the piezoelectric elements are surrounded by the adhesive to form spaces in which the piezoelectric elements are housed. Moreover, a configuration may be employed in which circuits such as drive circuits, or wiring, are formed on the sealing plate itself.

In the recording head 3 formed in the above manner, ink from the ink cartridge 7 is introduced to the pressure chambers 30 through the liquid entry path 18, the common liquid chamber 25, and the individual communication paths 26. In this state, drive signals from the controller are supplied to the piezoelectric elements 32 through the wiring members so as to drive the piezoelectric elements 32 to change the volume of the pressure chambers 30. Pressure changes accompanying the change in volume are utilized to eject ink droplets from the nozzles 22 that are in communication with the pressure chambers 30 through the penetrating flow paths 27.

Next, detailed explanation follows regarding the penetrating flow paths 27 of the present embodiment, with reference to FIG. 3. The penetrating flow paths 27 are flow paths connecting the nozzles 22 and the pressure chambers 30 together, as described above, and are formed in the single substrate of the flow path formation substrate 24. The penetrating flow paths 27 are formed with a cross-sectional area (flow path area) in a plane orthogonal to the thickness direction of the flow path formation substrate 24, in other words, in a plane running parallel to the flow path formation substrate 24 (a plane running parallel to a joining face between the flow path formation substrate 24 and the nozzle plate 21 (or the pressure chamber formation substrate 29)), that widens in steps on progression from the nozzle 22 side toward the pressure chamber 30 side. Accordingly, an opening area on the pressure chamber 30 side of the respective penetrating flow paths 27 is formed wider than an opening area on the nozzle 22 side of the respective penetrating flow paths 27. Each of the penetrating flow paths 27 of the present embodiment includes, in sequence from the nozzle 22 side, a first flow path portion 36 with a flow path area of a first area, a second flow path portion 37 with a flow path area of a second area, this being wider than the first area, and a third flow path portion 38 with a flow path area of a third area, this being wider than the second area. The respective flow path portions 36, 37, 38 each have a uniform flow path area. Note that the flow path portions 36, 37, 38 are each aligned centered on the same position in plan view.

A first diameter enlargement portion 41 is formed between the first flow path portion 36 and the second flow path portion 37, and connects the two together. A second diameter enlargement portion 42 is formed between the second flow path portion 37 and the third flow path portion 38, and connects the two together. The two diameter enlargement portions 41, 42 are configured with an increasing diameter on progression from the nozzle 22 side toward the pressure chamber 30 side. Namely, an inner peripheral face of the first diameter enlargement portion 41 configures a first inclined face 39 that is inclined with respect to a plane orthogonal to the thickness direction of the flow path formation substrate 24 (namely, with respect to a plane running parallel to the flow path formation substrate 24). An inner peripheral face of the second diameter enlargement portion 42 configures a second inclined face 40 that is inclined with respect to a plane orthogonal to the thickness direction of the flow path formation substrate 24 (namely, with respect to a plane running parallel to the flow path formation substrate 24). In other words, the first diameter enlargement portion 41 is a flow path portion with a periphery bounded by the first inclined face 39 (with an inner peripheral face configured by the first inclined face 39). The second diameter enlargement portion 42 is a flow path portion with a periphery bounded by the second inclined face 40 (with an inner peripheral face configured by the second inclined face 40). The first inclined face 39 is a step formed between the first flow path portion 36 and the second flow path portion 37, and the second inclined face 40 is a step formed between the second flow path portion 37 and the third flow path portion 38. An angle of inclination θ of the first inclined face 39 and the second inclined face 40 in the present embodiment (an angle with respect to the plane orthogonal to the thickness direction of the flow path formation substrate 24, namely, an angle with respect to a plane running parallel to the flow path formation substrate 24) is no less than 40° and no greater than 60°.

The opening area on the nozzle 22 side of the penetrating flow path 27 is formed narrower than the opening area on the pressure chamber 30 side of the penetrating flow path 27, thereby enabling a difference between the opening area of the nozzle 22 and the opening area on the nozzle 22 side of the penetrating flow path 27 to be reduced. Namely, the step 23 within the penetrating flow path 27 at a boundary between the flow path formation substrate 24 and the nozzle plate 21 can be made smaller. This thereby enables ink, air bubbles, and the like to be suppressed from pooling at the step 23 inside the penetrating flow path 27. This enables an increase in viscosity of pooled ink, undesirable effects thereof on the ink ejection characteristics, undesirable effects of pooled air bubbles on the ink ejection characteristics, and the like to be suppressed as a result.

In particular, in the present embodiment, the cross-sectional area of the penetrating flow path 27 becomes wider in steps on progression toward the pressure chamber 30 side. This thereby enables the step 23 inside the penetrating flow path 27 at the boundary between the flow path formation substrate 24 and the nozzle plate 21 to be made smaller, while suppressing an increase in flow path resistance within the penetrating flow path 27. Moreover, since the penetrating flow path 27 is formed in the flow path formation substrate 24 configured by a single substrate, the number of steps (inclined faces) in the penetrating flow path 27 can be set as desired. For example, configuring the penetrating flow path 27 with the plural flow path portions 36, 37, 38, as in the present embodiment, enables the steps formed between the respective flow path portions 36, 37, 38 to be made smaller. This thereby enables ink, air bubbles, and the like to be even further suppressed from pooling inside the penetrating flow path 27. Moreover, variation in the shape of the penetrating flow paths 27 as a result of positional misalignment between substrates, as can occur when a flow path formation substrate is configured from plural substrates (namely, when a flow path is formed by stacking plural substrates), does not occur, enabling variation in ink ejection characteristics to be suppressed. This thereby enables more stable ink ejection than in cases in which the flow path formation substrate is configured from plural substrates.

In the present embodiment, the step between the first flow path portion 36 and the second flow path portion 37 (the first inclined face 39), and the step between the second flow path portion 37 and the third flow path portion 38 (the second inclined face 40) are inclined with respect to the flow path formation substrate 24, thereby enabling ink, air bubbles, and the like to be further suppressed from pooling inside the penetrating flow path 27. Namely, the respective inclined faces 39, 40 are inclined toward the nozzle 22 side, thereby enabling ink, air bubbles, and the like to flow smoothly toward the nozzle 22 side. In particular, the first inclined face 39 and the second inclined face 40 are inclined at an angle of no less than 40° and no greater than 60° with respect to a plane orthogonal to the thickness direction of the flow path formation substrate 24, thereby enabling the flow of ink inside the penetrating flow path 27 to be made even smoother. Moreover, in the present embodiment, the flow path formation substrate 24 employs a silicon single crystal substrate with surfaces in a (110) plane, thereby enabling the penetrating flow path 27 to be formed easily and with high precision using wet etching. Manufacture of the flow path formation substrate 24 is facilitated as a result.

Explanation follows regarding a method for forming the penetrating flow path 27 using wet etching, with reference to FIG. 4 to FIG. 11. FIG. 4 to FIG. 11 are cross-sections to explain a manufacturing process of the flow path formation substrate 24. Note that the dashed lines in FIG. 7 to FIG. 10 indicate the position of a first opening 45 and a second opening 47 in a state prior to enlargement, in order to facilitate understanding of an enlargement range of the first opening 45 and the second opening 47.

Figure 4:
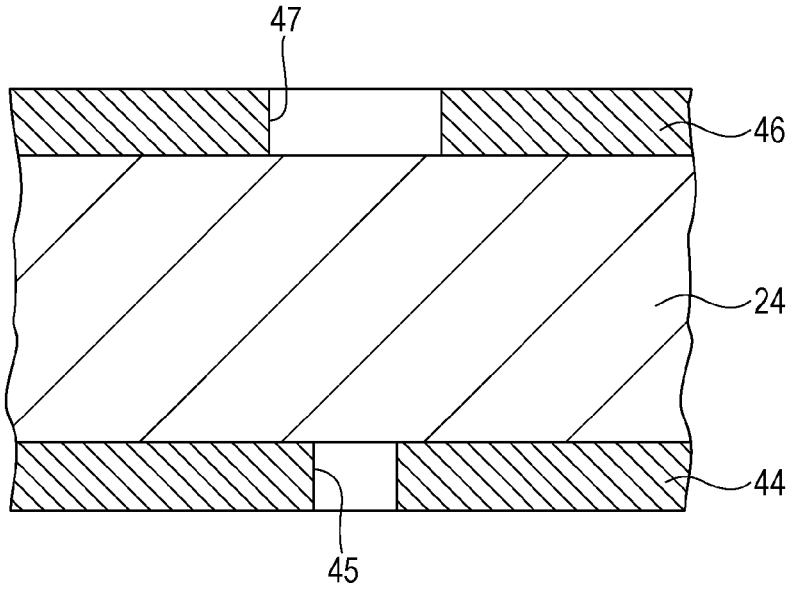
FIG. 4 is a cross-section to explain a manufacturing process of a flow path formation substrate.

First, as illustrated in FIG. 4, in a first mask layer forming process, a first mask layer 44 to mask against an etching liquid (for example, potassium hydroxide (KOH)) that etches the flow path formation substrate 24 is formed on a lower face (the face on the side for connection to the nozzle plate 21) of the flow path formation substrate 24 that is configured from a silicon single crystal substrate. The first opening 45 is then formed by removing the first mask layer 44 at a position corresponding to the penetrating flow path 27 (a position for forming the penetrating flow path 27). More specifically, after forming the mask layer over the entire lower face of the silicon single crystal substrate, the first opening 45 and the like are formed by performing an exposure process and a developing process. Note that the mask layer preferably employs $SiO_2$, SiN, or the like, with $SiO_2$ being employed as the mask layer in the present embodiment. Similarly, in a second mask layer forming process, a second mask layer 46 to mask against an etching liquid that etches the flow path formation substrate 24 is formed on an upper face (the face on the side for connection to the pressure chamber formation substrate 29) of the flow path formation substrate 24. The second opening 47 is then formed by removing the second mask layer 46 at a position corresponding to the penetrating flow path 27 (a positions where the penetrating flow path 27 will be formed). When this is performed, the second opening 47 is formed with a wider opening area than that of the first opening 45. Note that either the first mask layer forming process or the second mask layer forming process may be performed first.

Figure 5:
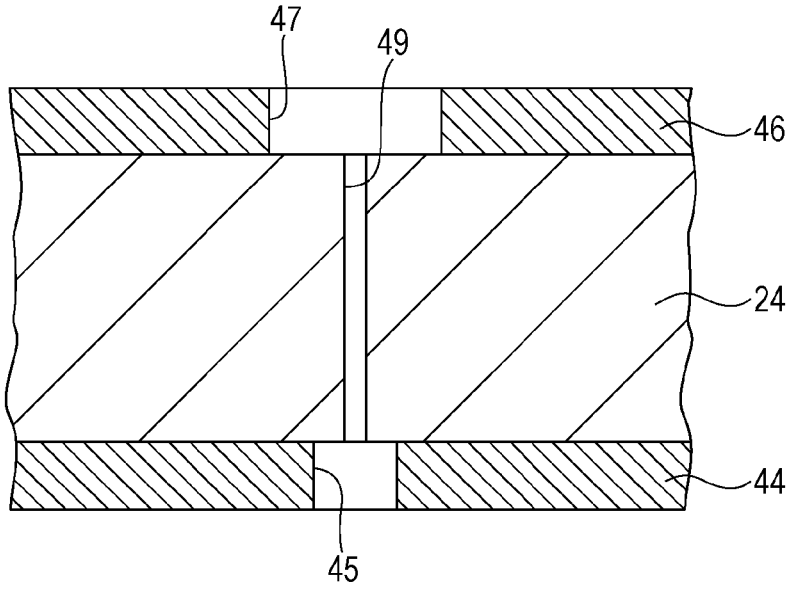
FIG. 5 is a cross-section to explain a manufacturing process of a flow path formation substrate.
Figure 6:
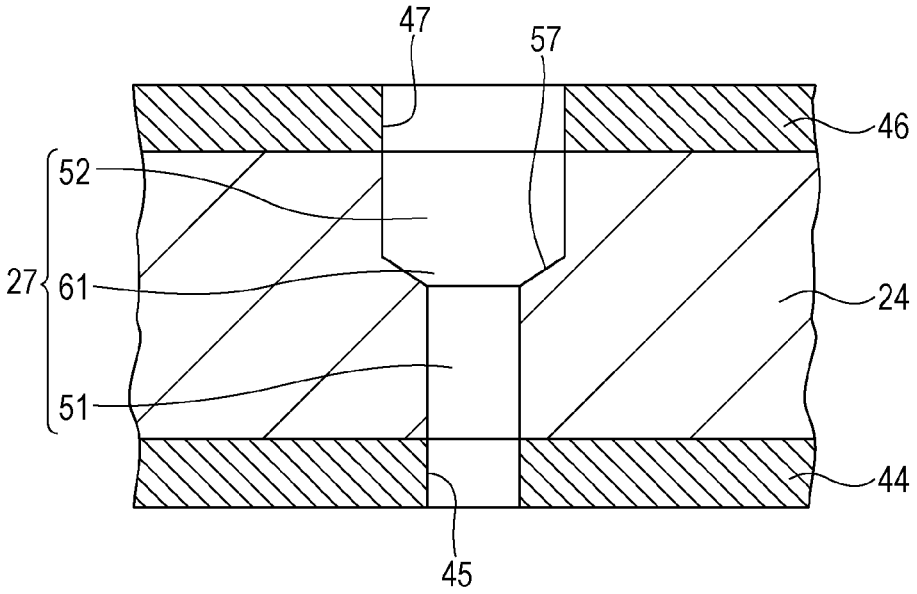
FIG. 6 is a cross-section to explain a manufacturing process of a flow path formation substrate.

Next, as illustrated in FIG. 5, in a through hole forming process, a through hole 49 is formed in the flow path formation substrate 24 to place the first opening 45 and the second opening 47 in communication with each other. The cross-sectional area of the through hole 49 is formed narrower than the respective opening areas of the first opening 45 and the second opening 47. The through hole 49 is formed using dry etching such as deep RIE, a laser, or a method combining these methods. Once the through hole 49 has been formed, as illustrated in FIG. 6, in a flow path forming process, the flow path formation substrate 24 is immersed in etching liquid and the etching liquid enters the flow path formation substrate 24 side through the first opening 45 and the second opening 47. Namely, the first opening 45, the second opening 47, and the through hole 49 are exposed to the etching liquid, and the periphery of the through hole 49 is etched (anisotropic etching), thereby forming the penetrating flow path 27. When this is performed, since the flow path formation substrate 24 is configured by a silicon single crystal substrate with surfaces (the upper surface and the lower surface) having a crystal plane orientation of that of a (110) plane, and since etching liquid configured from potassium hydroxide has a higher etching rate with respect to the (110) plane than with respect to other crystal planes, etching advances in a direction perpendicular to the surface of the flow path formation substrate 24. As a result, a first intermediate flow path portion 51 with a cross-sectional area corresponding to the opening area of the first opening 45 is formed toward the bottom, and a second intermediate flow path portion 52 with a cross-sectional area corresponding to the opening area of the second opening 47 is formed toward the top. Namely, the first intermediate flow path portion 51 is formed from the lower face (the first opening 45 side face) of the flow path formation substrate 24 to partway through the flow path formation substrate 24, and the second intermediate flow path portion 52 is formed from the upper face (the second opening 47 side face) of the flow path formation substrate 24 to partway through the flow path formation substrate 24, and has a wider cross-sectional area than the than the cross-sectional area of the first intermediate flow path portion 51. Side faces of the first intermediate flow path portion 51 and the second intermediate flow path portion 52 are bounded by (111) planes perpendicular to the surface of the flow path formation substrate 24. Moreover, a first intermediate diameter enlargement portion 61 is formed between the first intermediate flow path portion 51 and the second intermediate flow path portion 52 so as to connect the two together. The first intermediate diameter enlargement portion 61 is configured so as to increase in diameter on progression from the first intermediate flow path portion 51 side toward the second intermediate flow path portion 52 side. Namely, an inner peripheral face of the first intermediate diameter enlargement portion 61 configures a first intermediate inclined face 57 that is inclined with respect to the flow path formation substrate 24.

Figure 7:
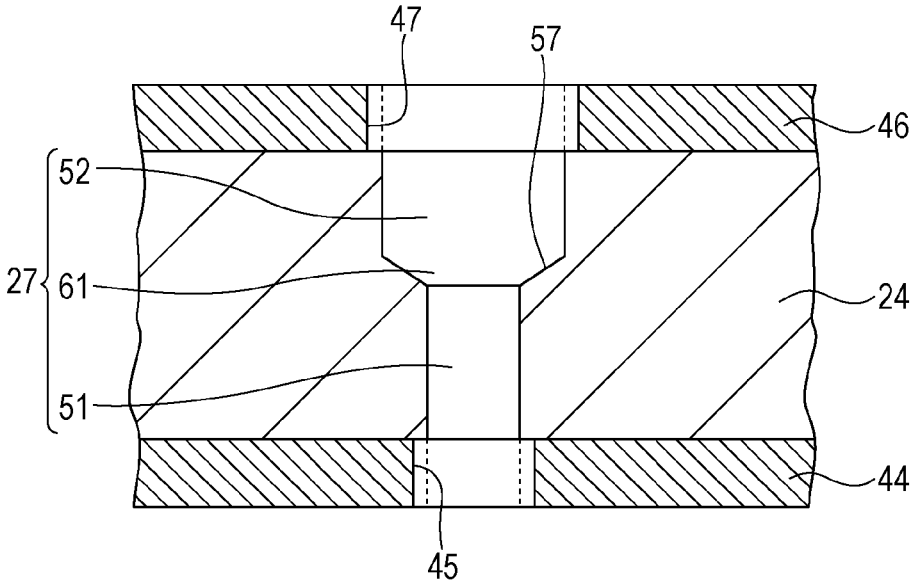
FIG. 7 is a cross-section to explain a manufacturing process of a flow path formation substrate.
Figure 8:
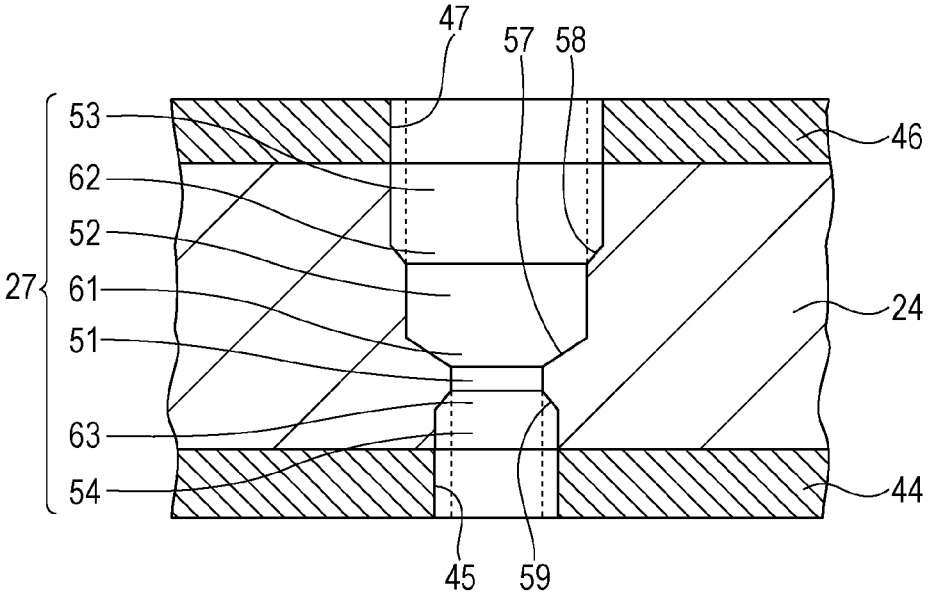
FIG. 8 is a cross-section to explain a manufacturing process of a flow path formation substrate.

Once the penetrating flow path 27 has been formed, as illustrated in FIG. 7, in a mask opening enlargement process, the opening areas of the first opening 45 and the second opening 47 are widened. Specifically, the flow path formation substrate 24 is immersed in an etching liquid (for example hydrofluoric acid (HF)) that etches the mask layer, causing the first mask layer 44 and the second mask layer 46 to retreat slightly. The opening area of the first opening 45 is thereby widened slightly, and the opening area of the second opening 47 is similarly widened. Next, in a flow path enlargement process, the flow path formation substrate 24 is immersed in an etching liquid that etches the flow path formation substrate 24, and the etching liquid enters the flow path formation substrate 24 side through the first opening 45 and the second opening 47 that have enlarged opening areas. Namely, the first opening 45 and the second opening 47 that have enlarged opening areas, and the through hole 49, are exposed to the etching liquid, enlarging at least a portion of the cross-sectional area of the penetrating flow path 27. Specifically, the first intermediate inclined face 57 is bored downward such that the second intermediate flow path portion 52 and the first intermediate diameter enlargement portion 61 move downward. Moreover, an upper side wall of the second intermediate flow path portion 52 is bored downward corresponding to the enlarged second opening 47. Accordingly, as illustrated in FIG. 8, a third intermediate flow path portion 53 with a wider cross-sectional area than the cross-sectional area of the second intermediate flow path portion 52 is formed above the second intermediate flow path portion 52. Moreover, a second intermediate diameter enlargement portion 62 is formed between the second intermediate flow path portion 52 and the third intermediate flow path portion 53 so as to connect the two together. The second intermediate diameter enlargement portion 62 is configured so as to increase in diameter on progression from the second intermediate flow path portion 52 side toward the third intermediate flow path portion 53 side. Namely, an inner peripheral face of the second intermediate diameter enlargement portion 62 configures a second intermediate inclined face 58 that is inclined with respect to the flow path formation substrate 24.

A lower side wall of the first intermediate flow path portion 51 is bored upward corresponding to the enlarged first opening 45. Accordingly, a fourth intermediate flow path portion 54 with a wider cross-sectional area than the cross-sectional area of the first intermediate flow path portion 51 is formed below the first intermediate flow path portion 51. A third intermediate diameter enlargement portion 63 is also formed between the first intermediate flow path portion 51 and the fourth intermediate flow path portion 54 so as to connect the two together. The third intermediate diameter enlargement portion 63 is configured so as to increase in diameter on progression from the first intermediate flow path portion 51 side toward the fourth intermediate flow path portion 54 side. Namely, an inner peripheral face of the third intermediate diameter enlargement portion 63 configures a third intermediate inclined face 59 that is inclined with respect to the flow path formation substrate 24.

Figure 9:
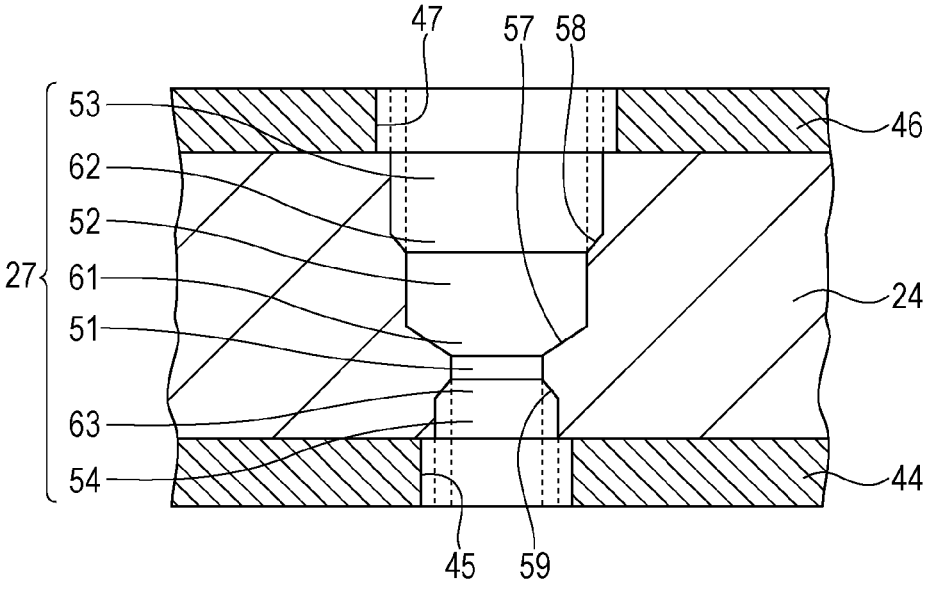
FIG. 9 is a cross-section to explain a manufacturing process of a flow path formation substrate.
Figure 10:
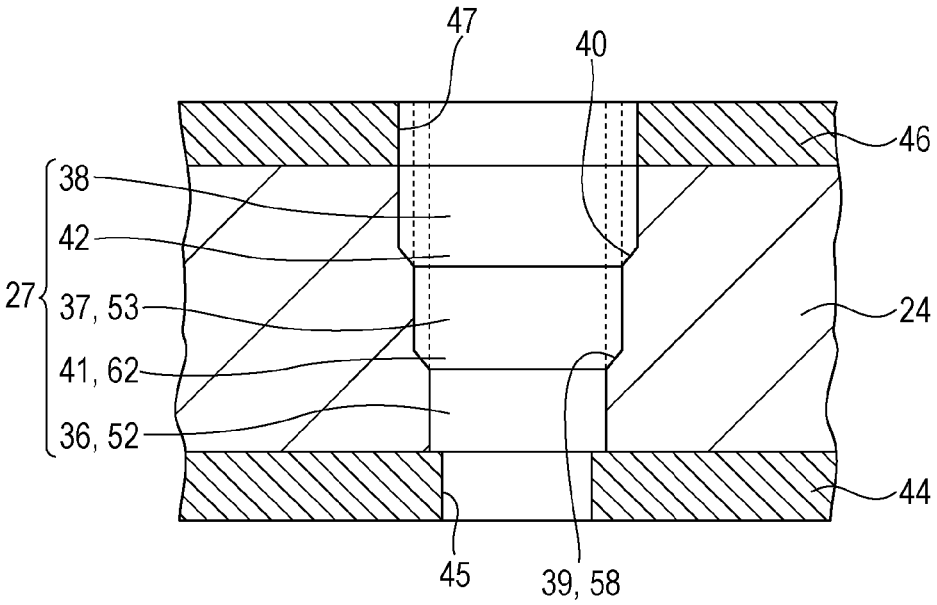
FIG. 10 is a cross-section to explain a manufacturing process of a flow path formation substrate.
Figure 11:
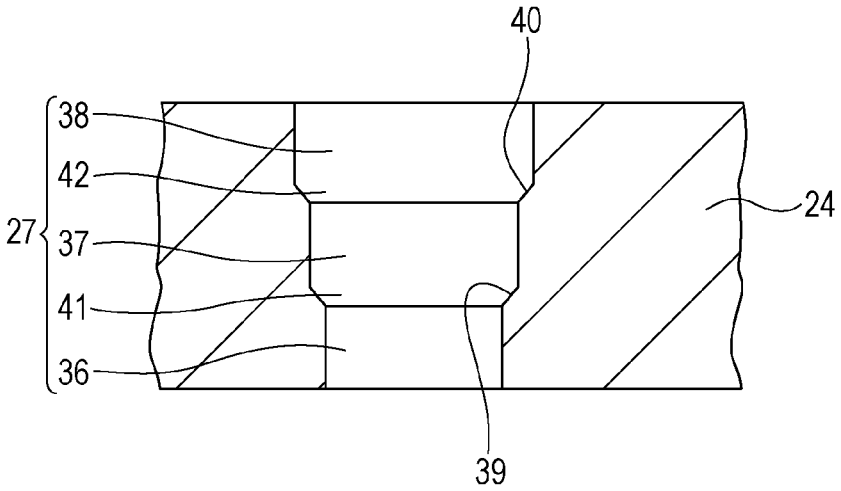
FIG. 11 is a cross-section to explain a manufacturing process of a flow path formation substrate.

Once the respective intermediate flow path portions 51, 52, 53, 54 have been formed, as illustrated in FIG. 9, in a repeat mask opening enlargement process, the opening areas of the first opening 45 and the second opening 47 are enlarged even further. Namely, the flow path formation substrate 24 is again immersed in an etching liquid that etches the mask layers, causing the first mask layer 44 and the second mask layer 46 to retreat further. Then, in a repeat flow path enlargement process, the flow path formation substrate 24 is immersed in an etching liquid that etches the flow path formation substrate 24, further enlarging the cross-sectional area of the penetrating flow path 27. Specifically, the first intermediate inclined face 57 is bored downward, and reaches the lower face side of the flow path formation substrate 24. Accordingly, as illustrated in FIG. 10, the second intermediate flow path portion 52 moves downward, accompanying which the first intermediate flow path portion 51, the fourth intermediate flow path portion 54, the first intermediate diameter enlargement portion 61, and the third intermediate diameter enlargement portion 63 are incorporated into the second intermediate flow path portion 52 and disappear. The second intermediate flow path portion 52 becomes the first flow path portion 36 formed from the lower face of the flow path formation substrate 24 to partway through the flow path formation substrate 24. The second intermediate inclined face 58 is bored downward, and the third intermediate flow path portion 53 and the second intermediate diameter enlargement portion 62 move downward to become the second flow path portion 37 and the first diameter enlargement portion 41 respectively. Moreover, an upper side wall of the third intermediate flow path portion 53 is bored downward corresponding to the enlarged second opening 47. The third flow path portion 38 with a wider cross-sectional area than the cross-sectional area of the second flow path portion 37 is thereby formed above the third intermediate flow path portion 53 that has moved downward (namely, the second flow path portion 37). The second diameter enlargement portion 42 is formed between the second flow path portion 37 and the third flow path portion 38. This thereby forms the penetrating flow path 27 configured by the first flow path portion 36, the second flow path portion 37, and the third flow path portion 38 in sequence from the lower face side. Finally, as illustrated in FIG. 11, in a mask removal process, the first mask layer 44 and the second mask layer 46 are removed, thereby forming the flow path formation substrate 24 provided with the penetrating flow path 27 of the present embodiment.

In this manner, opening area enlargement processes and flow path enlargement processes are performed twice each. This thereby enables easy formation, in sequence from the nozzle 22 side, of the first flow path portion 36 with the first area as a cross-sectional area (flow path area) in a plane orthogonal to the thickness direction of the flow path formation substrate 24 (a plane running parallel to the flow path formation substrate 24), the second flow path portion 37 having the second area wider than the first area as a cross-sectional area in a plane orthogonal to the thickness direction of the flow path formation substrate 24, and the third flow path portion 38 having the third area wider than the second area as a cross-sectional area in a plane orthogonal to the thickness direction of the flow path formation substrate 24. Namely, the penetrating flow path 27 can easily be formed with a flow path area that widens in steps on progression toward the pressure chamber 30 side. This thereby facilitates manufacture of the flow path formation substrate 24, and therefore, facilitates manufacture of the recording head 3. Moreover, in the present embodiment, a single silicon single crystal substrate is wet etched to form the penetrating flow path 27, thereby enabling the steps formed between the respective flow path portions 36, 37, 38 to be configured by the inclined faces 39, 40. This thereby enables ink, air bubbles, and the like to be suppressed from pooling between the respective flow path portions 36, 37, 38. This moreover enables the angles of the inclined faces 39, 40 to be controlled using, for example, the concentration of the etching liquid.

In the embodiment described above, the opening area enlargement processes and the flow path enlargement process are performed twice each. However, there is no limitation thereto. It is sufficient that an opening area enlargement process and a flow path enlargement process are each performed at least once, according to the number of steps (inclined faces) and the number of flow path portions within the penetrating flow path 27. For example, in cases in which there are three steps (inclined faces) within the penetrating flow path, the opening area enlargement process and the flow path enlargement process may be performed three times each. Sometimes, depending on, for example, the concentration of the etching liquid, the first intermediate flow path portion 51 such as that illustrated in FIG. 8 is not formed during the first flow path enlargement process. Namely, sometimes the fourth intermediate flow path portion 54 formed on the first opening 45 side, and the second intermediate flow path portion 52 positioned partway through the penetrating flow path 27, are connected through an intermediate diameter enlargement portion. Whichever the case may be, the second intermediate flow path portion 52 penetrates through to the lower face side of the silicon single crystal substrate in the repeat flow path enlargement process, such that ultimately, a similar shape is achieved.

In the above explanation, explanation has been given regarding an example in which the recording head 3 is a type of liquid ejecting head. However, the invention may be applied to other liquid ejecting heads as long as they are provided with a penetrating flow path. For example, the invention may be applied to colorant ejection heads employed in the manufacture of color filters for liquid crystal displays or the like, electrode material ejection heads employed in electrode formation in organic electro luminescence (EL) displays, face emission displays (FED) or the like, or bioorganic material ejection heads employed in the manufacture of biochips (biochemical devices).

What is claimed is:

1. A liquid ejecting head comprising:

a pressure chamber formation substrate having a pressure chamber formed therein;

a flow path formation substrate that is connected to the pressure chamber formation substrate and that has a flow path in communication with the pressure chamber formed in a state penetrating through the flow path formation substrate in a thickness direction thereof;

a nozzle plate that is connected to the flow path formation substrate on an opposite side to the pressure chamber formation substrate and that has a nozzle in communication with the flow path opened therein;

the flow path formation substrate being configured from a single substrate; and an opening area on a pressure chamber side of the flow path being formed wider than an opening area on a nozzle side of the flow path, wherein the flow path includes at least (1) a first flow path portion having a first area that is a cross-sectional area in a plane orthogonal to the thickness direction and (2) a second flow path portion having a second area that is wider than the first area, the second area being a different cross-sectional area in the plane that is orthogonal to the thickness direction; and wherein a plurality of inner faces are located within the flow path, the plurality of inner faces including a first inclined transition face, wherein a first end of the first inclined transition face commences at the first flow path portion and a second end of the first inclined transition face terminates at the second flow path portion to form an inclined transition plane spanning between the first flow path portion and the second flow path portion, the first inclined transition face being inclined with respect to a plane orthogonal to the thickness direction, the first inclined transitional face being structured to allow a flow of air bubbles present in a liquid to flow from the pressure chamber to the nozzle.

2. The liquid ejecting head of claim 1, wherein a cross-sectional area of the flow path in a plane orthogonal to the thickness direction widens in steps on progression toward the pressure chamber side.

3. The liquid ejecting head of claim 1, wherein the inclined transition face is inclined at an angle of no less than 40° and no greater than 60° with respect to the plane orthogonal to the thickness direction.

4. The liquid ejecting head of claim 1, wherein:

the flow path formation substrate is a silicon single crystal substrate; and a plane orientation of a face of the flow path formation substrate on the opposite side to the face connected to the nozzle plate is that of a (110) plane.

5. A liquid ejecting apparatus comprising the liquid ejecting head of claim 1.

6. A liquid ejecting apparatus comprising the liquid ejecting head of claim 2.

7. A liquid ejecting apparatus comprising the liquid ejecting head of claim 1, wherein the nozzle plate is a silicon single crystal substrate, the nozzle plate including an upper face and a lower face, the upper face and the lower face both having a crystal plane orientation of that of a plane.

8. A liquid ejecting apparatus comprising the liquid ejecting head of claim 3.

9. A liquid ejecting apparatus comprising the liquid ejecting head of claim 4.

10. A liquid ejecting head manufacturing method for a liquid ejecting head including a pressure chamber formation substrate having a pressure chamber formed therein, a flow path formation substrate that is connected to the pressure chamber formation substrate and that has a flow path in communication with the pressure chamber formed in a state penetrating through the flow path formation substrate in a thickness direction thereof, and a nozzle plate that is connected to the flow path formation substrate on an opposite side to the pressure chamber formation substrate, and that has a nozzle in communication with the flow path opened therein, the manufacturing method comprising:

forming a first mask layer on a face of the flow path formation substrate on the side for connection to the nozzle plate to mask against an etching liquid that etches the flow path formation substrate, and removing the first mask layer at a position for forming the flow path so as to form a first opening;

forming a second mask layer on a face of the flow path formation substrate on the side for connection to the pressure chamber formation substrate to mask against an etching liquid, and removing the second mask layer at a position for forming the flow path so as to form a second opening with a wider opening area than the first opening;

forming a through hole that places the first opening and the second opening in communication through the flow path formation substrate;

forming the flow path by exposing the first opening, the second opening, and the through hole to an etching liquid;

enlarging the mask openings by widening the opening areas of the first opening and the second opening; and enlarging the flow path so as to enlarge a cross-sectional area of at least a portion of the flow path by exposing the first opening and the second opening having enlarged opening areas, and exposing the through hole, to etching liquid, wherein the mask opening enlarging and the flow path enlarging are each performed at least once.

11. The liquid ejecting head of claim 1, wherein an incline angle of the inclined face is between 45 degrees and 55 degrees with respect to the plane orthogonal to the thickness direction.

* * * * *